US010519707B2

(12) United States Patent
Cappellotto

(10) Patent No.: US 10,519,707 B2
(45) Date of Patent: Dec. 31, 2019

(54) ASSEMBLY FOR MOVING A DOOR OF A PIECE OF FURNITURE

(71) Applicant: Hettich-ONI GmbH & Co. KG, Vlotho (DE)

(72) Inventor: Leandro Cappellotto, Pordenone (IT)

(73) Assignee: Hettich-ONI GmbH & Co. KG, Vlotho (DE)

( * ) Notice: Subject to any disclaimer, the term of this patent is extended or adjusted under 35 U.S.C. 154(b) by 0 days.

(21) Appl. No.: 15/778,417

(22) PCT Filed: Nov. 30, 2016

(86) PCT No.: PCT/EP2016/079230

§ 371 (c)(1),
(2) Date: May 23, 2018

(87) PCT Pub. No.: WO2017/093290

PCT Pub. Date: Jun. 8, 2017

(65) Prior Publication Data

US 2018/0347251 A1 Dec. 6, 2018

(30) Foreign Application Priority Data

Nov. 30, 2015 (IT) ..... 102015000078260

(51) Int. Cl.
*E05D 15/00* (2006.01)
*E05F 15/614* (2015.01)
(Continued)

(52) U.S. Cl.
CPC ..... *E05F 15/614* (2015.01); *E05D 15/46* (2013.01); *E05F 1/14* (2013.01); *E05F 15/63* (2015.01);
(Continued)

(58) Field of Classification Search
CPC ..... E05F 15/614; E05F 15/46; E05F 15/63; E05F 15/40; E05F 1/14; E05D 3/12; E05Y 2800/238; E05Y 2800/242; E05Y 2800/20
(Continued)

(56) References Cited

U.S. PATENT DOCUMENTS 4,658,473 A * 4/1987 Schema ..... E05F 1/1261 16/286
5,904,411 A * 5/1999 Hayakawa ..... E05D 15/582 16/289
(Continued)

FOREIGN PATENT DOCUMENTS

DE 20 2010 015 091 U1 2/2012
EP 2 248 981 A1 11/2010
(Continued)

OTHER PUBLICATIONS

International Search Report of PCT/EP2016/079230, dated Feb. 13, 2017.
(Continued)

*Primary Examiner* — Jerry E Redman
(74) *Attorney, Agent, or Firm* — Collard & Roe, P.C.

(57) ABSTRACT

An assembly for moving a door of a piece of furniture, the assembly being adapted to move between a retracted configuration and an extended configuration so as to drive the door respectively between a closing position and an opening position. In particular, the assembly comprises a first arm adapted to be rotatably coupled with a first end to the side around a first rotational axis, a second arm articulated with a first end to a second end of the first arm around a second rotational axis, a third arm articulated to a second end of the second arm around a third rotational axis, the third arm being able to be attached to the door, and guiding means for
(Continued)

guiding the roto-translatory motion of the door between the closing position and the opening position.

10 Claims, 13 Drawing Sheets

(51) Int. Cl.
*E05F 15/63* (2015.01)
*E05D 15/46* (2006.01)
*E05F 1/14* (2006.01)
*E05D 3/12* (2006.01)

(52) U.S. Cl.
CPC ..... *E05D 3/12* (2013.01); *E05Y 2800/238* (2013.01); *E05Y 2800/242* (2013.01); *E05Y 2900/20* (2013.01)

(58) Field of Classification Search
USPC ..... 49/246, 247, 250, 251
See application file for complete search history.

(56) References Cited

U.S. PATENT DOCUMENTS 7,065,833 B2 * 6/2006 Kropf ..... E05D 3/142 16/286
7,178,202 B2 * 2/2007 Hirtsiefer ..... E05D 3/14 16/286
9,145,722 B2 * 9/2015 Gherardi ..... E05D 11/08
9,316,036 B2 * 4/2016 Collene ..... E05F 1/1058
9,353,562 B2 * 5/2016 Oshima ..... E05F 1/14
9,625,160 B2 * 4/2017 Xiao ..... F24C 15/023
2002/0189052 A1 12/2002 Melhuish
2004/0239213 A1 * 12/2004 Hirtsiefer ..... E05D 15/262 312/109
2007/0124893 A1 * 6/2007 Brustle ..... E05F 1/1075 16/296
2010/0251521 A1 * 10/2010 Donoho ..... E05D 11/06 16/343
2012/0000130 A1 * 1/2012 Kashiwaguma ..... E05F 1/1058 49/348
2012/0084944 A1 * 4/2012 Hirtsiefer ..... E05D 3/14 16/302
2013/0031746 A1 * 2/2013 Hasegawa ..... E05D 3/14 16/50
2013/0333291 A1 12/2013 Blum
2016/0333620 A1 * 11/2016 Holzapfel ..... E05F 1/1058
2017/0247923 A1 * 8/2017 Hirtsiefer ..... E05D 3/16
2017/0284144 A1 * 10/2017 Yasaka ..... E05F 15/614
2018/0216832 A1 * 8/2018 White ..... F24C 15/023
2018/0363348 A1 * 12/2018 Schluge ..... E05D 15/401
2019/0010747 A1 * 1/2019 Bohle ..... E05F 1/1058
2019/0040670 A1 * 2/2019 Dora ..... E05F 15/616
2019/0093404 A1 * 3/2019 Schmid ..... E05D 11/06

FOREIGN PATENT DOCUMENTS

WO 2007/045631 A1 4/2007
WO 2012/059173 A1 5/2012

OTHER PUBLICATIONS

Written Opinion of the International Searching Authority of PCT/EP2016/079230, dated Feb. 13, 2017.

* cited by examiner

ASSEMBLY FOR MOVING A DOOR OF A PIECE OF FURNITURE

CROSS REFERENCE TO RELATED APPLICATIONS

This application is the National Stage of PCT/EP2016/079230 filed on Nov. 30, 2016, which claims priority under 35 U.S.C. § 119 of Italian Application No. 102015000078260 filed on Nov. 30, 2015, the disclosures of which are incorporated by reference. The international application under PCT article 21(2) was published in English.

BACKGROUND OF THE INVENTION

This invention relates to an assembly with articulated arms for moving a door of a piece of furniture by means of a roto-translatory motion, between a closing position, in which said door lies essentially on a vertical plane, with abutment with respect to the sides of said piece of furniture, and an opening position, wherein said door is cantilevered, corresponding to the top of the piece of furniture or an overlying shelf. The invention further relates to a piece of furniture.

In the furniture industry, furniture is normally made of parallelepiped formats with, as is known, two vertical parallel sides, a top, a base and an optional rear wall, defining an internal compartment where objects, food, clothing and so on can be stored.

The front opening through which said internal compartment is accessed is selectively closed by means of one or more doors, movable between a closing position, in which access to the compartment is prevented, and an opening position, in which the interior contents can be accessed.

The passage between said closing position and said opening position can be carried out in different ways: in fact, the doors can be, for example, hinged on one side of the piece of furniture in such a way that the passage from one position to another essentially takes place by rotation around a vertical axis, thus a considerable space is required and the user's lateral movement is hindered.

To overcome this drawback, sliding doors have been proposed, in which the passage from one position to another takes place by lateral or vertical sliding; however, access to a part of the interior compartment of the piece of furniture is difficult or impossible.

Recently, in particular, regarding hanging furniture for example for kitchens, but also living rooms and bathrooms, the market is aiming at opening/closing systems where the door in an opening position is "cantilevered" from the body of the piece of furniture corresponding to the cover of the piece of furniture or possibly on the top shelf in the case of furniture with more spaces; this solution is highly appreciated as it is more ergonomic and allows for easy lateral movement by users even when the door is in the opening position.

In particular, the opening position can be achieved by ensuring door rotation of at least 90° from the closing position, so that this essentially lies on the same plane defined by the cover of the piece of furniture; However, in order to ensure a greater accessibility to the interior compartment, it is preferable that the door rotates at an angle greater than 90° from the closing position, so that this, in the opening position, is placed along a slanted plane with respect to the plane defined by the top, and preferably above it.

In order to meet this condition, the passage from the closing position to the opening position of the door must essentially take place according to a consistent trajectory in a roto-translatory motion, i.e. a combined movement in which the door contextually makes a translation, moving away from the piece of furniture and a rotation around an essentially horizontal axis; obviously this trajectory must be traced back by the door in the passage between the opening position and the closing position. This allows the trajectory of the door not to interfere, during the passage between the opening position and closing position, with any other doors, arranged in a coplanar position to the one to be moved and adjacent thereto.

Moreover, since the door in the opening position is essentially "cantilevered" from the body of the piece of furniture, for safety reasons, means must be provided that keep it in this position, preventing it, due to the action of its own weight, from uncontrollably returning to the closing position.

There are different types of devices that enable this movement to be activated. For example, systems are known that use gas pistons or springs hinged at one end to the inner side of the piece of furniture and with opposite end to the associated door, designed so that the weight of the door can be lifted and the closing movement counteracted. In such systems, the trajectory of the door is driven by variable pivot hinges attached to the top edge of the door and to the cover of the piece of furniture.

However, such systems have a drawback because numerous elements must be used and (many) holes made to attach them to the piece of furniture, both in the sides and on its top. Moreover, in particular in the case of gas pistons, because the size of the door and its weight may vary, many different types of pistons with variable force must be prepared and kept in stock.

Another known type of device for handling a door uses mechanisms with articulated arms that can be attached to the inner surface of the sides of the piece of furniture and can perform the same desired roto-translatory movement and keep the door in an opening position without needing to use hinges in the cover of the piece of furniture.

Lifting mechanisms for doors of this type are described for example in documents WO 2012/059173 and US 2013/0333291, both of which essentially include the same elements, organized in a different way; in particular, they comprise an elastic mechanism, such as a spring, that is rotatably coupled with a first end at the side of the piece of furniture around a first axis, e.g. a first pin, and associated at the opposite end with a rigid first arm, rotating around a second axis, e.g. a second pin, also attached to the side of the piece of furniture. This first rigid arm is in turn operationally connected to said door by means of numerous varied articulated elements between them, some of which are rotatably coupled around stationary rotational axes.

Therefore, all these mechanisms require at least three axes/pins attached to the side of the piece of furniture to enable movement of the door.

A cover casing, generally made of polymeric material, is then attached to the side of the piece of furniture to hold and protect the assembly of the door, also avoiding that users can accidently injure themselves by trapping their fingers inside the assembly when it is moving.

Although these mechanisms normally work satisfactorily, some drawbacks have been found: first of all, they are rather complex and bulky, detracting useful space from the inside of the piece of furniture and harming its aesthetic appearance.

Moreover, despite the presence of the cover casing, there is a possibility that users can also be injured; in fact, when the door is in the opening position, and therefore the assembly is in an extended configuration, the inner cavity of the cover casing is essentially accessible through a side opening required for the movement of the articulated arms.

Finally, if necessary, such mechanisms can be servo-assisted, attaching linear actuators operated by electric motors to them, which makes them even more bulky.

SUMMARY OF THE INVENTION

The aim of this invention is to overcome the drawbacks of the prior art referred to above by proposing an assembly of doors for furniture that is more compact and safer.

For the aforementioned purpose, an aim of this invention is to provide an assembly of a door for a piece of furniture that requires the minimum number of fixed points for the side of the piece of furniture, thus helping to preserve its aesthetic appearance and at the same time make it aesthetically pleasing as such, without leaving significant visible openings towards the inside of the assembly and without requiring attachment of the cover casing.

Another aim of this invention is to provide an assembly of doors for furniture that is absolutely practical and ensures the door moves smoothly.

Another aim of this invention is to provide an assembly of doors for furniture that achieves the aforementioned task and goals with competitive production costs, so that its use is also advantageous from an economic standpoint and can be obtained with conventional and known tools, machinery and equipment.

The aforementioned task and goals and others that will be shown below are achieved by an assembly of doors for furniture comprising at least one side and being adapted to move between a retracted configuration and an extended configuration so as to drive the door respectively between a closing position, wherein the door lies essentially on a vertical plane, and an opening position, wherein the is cantilevered with respect to the side, according to a roto-translatory motion.

An inventive assembly of the above-mentioned kind is characterized in that it comprises a first arm adapted to be rotatably coupled with a first end to said side around a first rotational axis, preferably a first pin, a second arm articulated with a first end to a second end of said first arm rotatable around a second rotational axis, preferably a second pin, a third arm articulated to a second end of said second arm rotatable around a third rotational axis, preferably a third pin, said third arm being associable with said door. Furthermore, guiding means are provided for guiding said roto-translatory motion of said door between said closing position and said opening position, wherein in the passage between said retracted configuration and said extended configuration, said assembly rotates about said first rotational axis, forming a fixed center of rotation, said second and third rotational axes forming instant centers of rotation, movable together with said arms.

This way, one stationary rotational axis is sufficient to support the door, which allows a slim design that preserves the appearance of the side of the piece of furniture. Furthermore, no additional support means are required, e.g. no additional hinge for mounting the door to a body of the piece of furniture is needed.

In a preferred embodiment, the assembly further comprises driving and retaining means arranged and configured for driving the opening movement of said door and retaining said door in the opening position when said assembly is in the extended configuration, and returning said door towards the closing position and retaining said door in the closing position when said assembly is in the retracted configuration.

In a further preferred embodiment of the assembly said driving and retaining means comprise preloaded elastic means hinged with a first end coaxially to said first arm around said first rotational axis, and with the opposite end to said second arm.

In a further preferred embodiment of the assembly said elastic means comprise a plurality of helical springs, housed inside a containing member formed by a first and a second containing portions, which are separated from each other and arranged at respective ends of said plurality of helical springs.

In a further preferred embodiment the assembly further comprises adjusting means for adjusting the preload of said elastic means, wherein the adjusting means comprise at least one adjusting screw integral with first abutment means and coaxially insertable from a first end of said elastic means, said adjusting screw being adapted to cooperate with a corresponding engaging body coaxially insertable from said second end of said elastic means and integral with second abutment means to compress or decompress said elastic means between said first and said second abutment means.

In a further preferred embodiment of the assembly said guiding means comprise a first tie rod articulated with a first end about a fourth rotational axis associable with said side and with the opposite end being connectable to said second arm around a fifth rotational axis, preferably a fifth pin, and a second tie rod articulated with a first end to the second end of said first arm about a sixth rotational axis, preferably a sixth pin, and with the opposite end being connected to said first end of said third arm about a seventh rotational axis, preferably a seventh pin.

In a further preferred embodiment of the assembly said first arm, said second arm and said third arm are formed by box-shaped rigid hollow bodies, housing at least said guiding means and said driving and retaining means.

In a further preferred embodiment the assembly comprises dampening means for dampening and controlling the movement of said door in the passage from said opening position to the closing position.

In a further preferred embodiment of the assembly the actuating means are associated with said assembly through transmission means to facilitate the movement of said door, said actuating means comprising at least an electric motor associated with said side, said transmission means comprising at least one toothed wheel adapted to rotatably transmit the motion imparted by said at least one motor electrical to a corresponding toothed wheel mounted coaxially to said first axis or pin and integral with said first arm.

An inventive piece of furniture provided with at least a side and a door is characterized in that it comprises an assembly as described above. The same advantages as described in connection with the assembly arise.

BRIEF DESCRIPTION OF THE DRAWINGS

The advantages and features of the invention are shown in the following description, as examples but not limited thereto, regarding the attached figures, in which.

DETAILED DESCRIPTION OF THE INVENTION

Figure 1A:
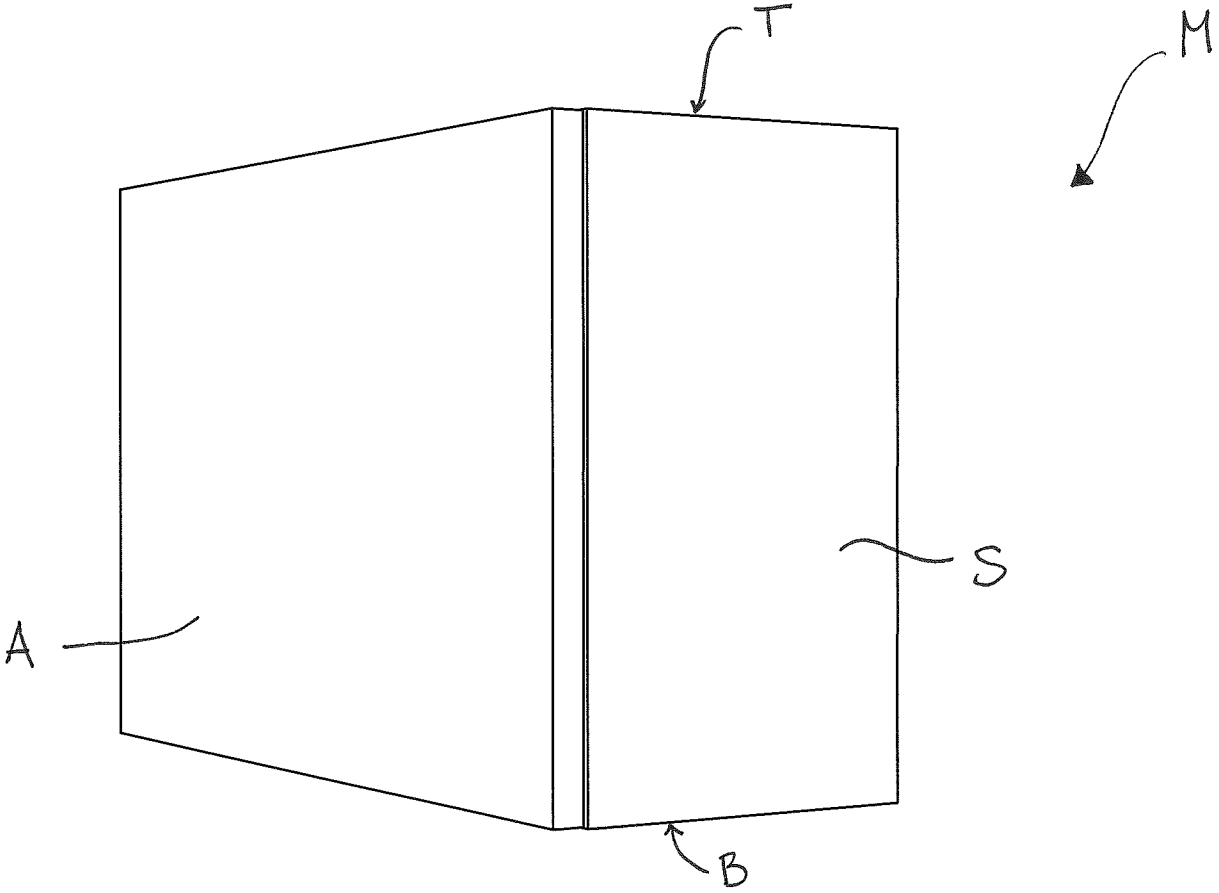
FIG. 1A is a perspective view of a cabinet including an assembly of a door according to this invention, with the door in a closing position.
Figure 1C:
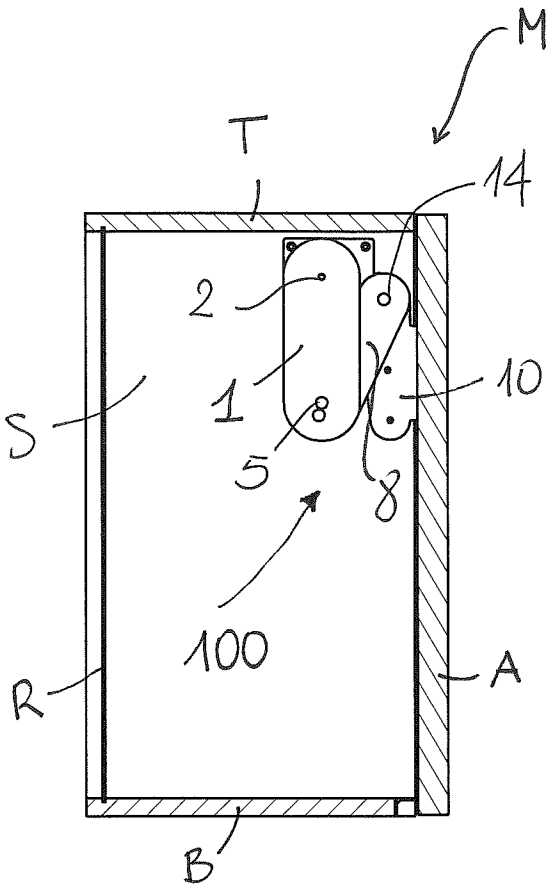
FIG. 1C shows the piece of furniture in the previous figures, sectioned along the C-C plane in FIG. 1B in order to show an assembly of a door according to this invention in a retracted configuration.
Figure 1B:
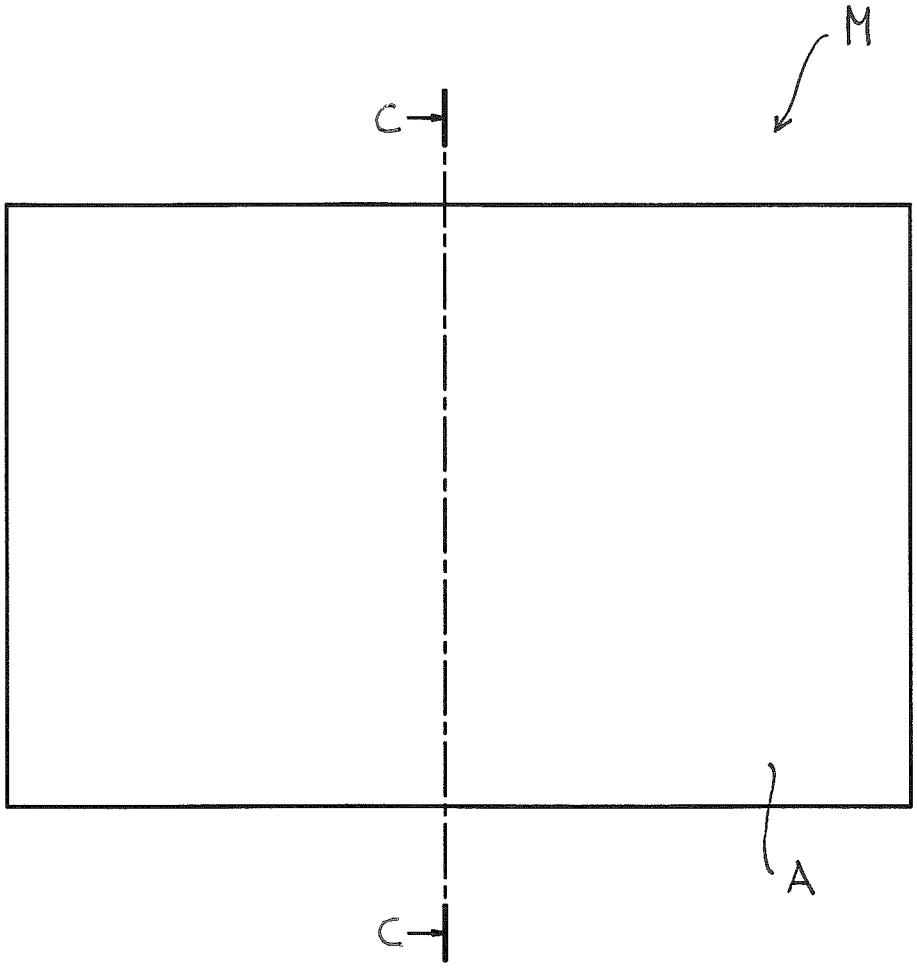
FIG. 1B is a front view of the piece of furniture shown in the previous figure.
Figure 2A:
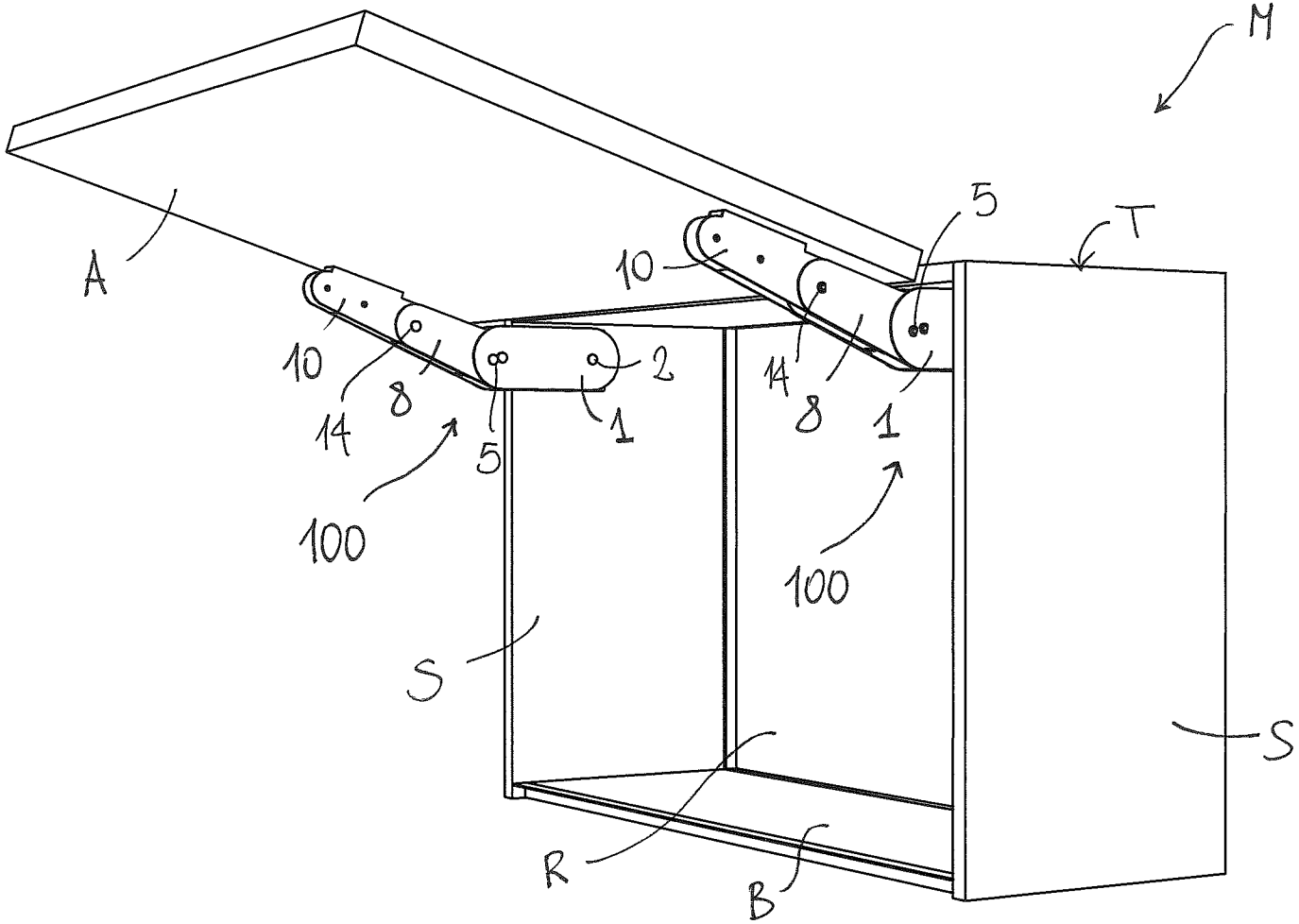
FIG. 2A is a perspective view of a piece of furniture including an assembly of a door according to this invention, with the door in an opening position and said assembly in an extended configuration.
Figure 2C:
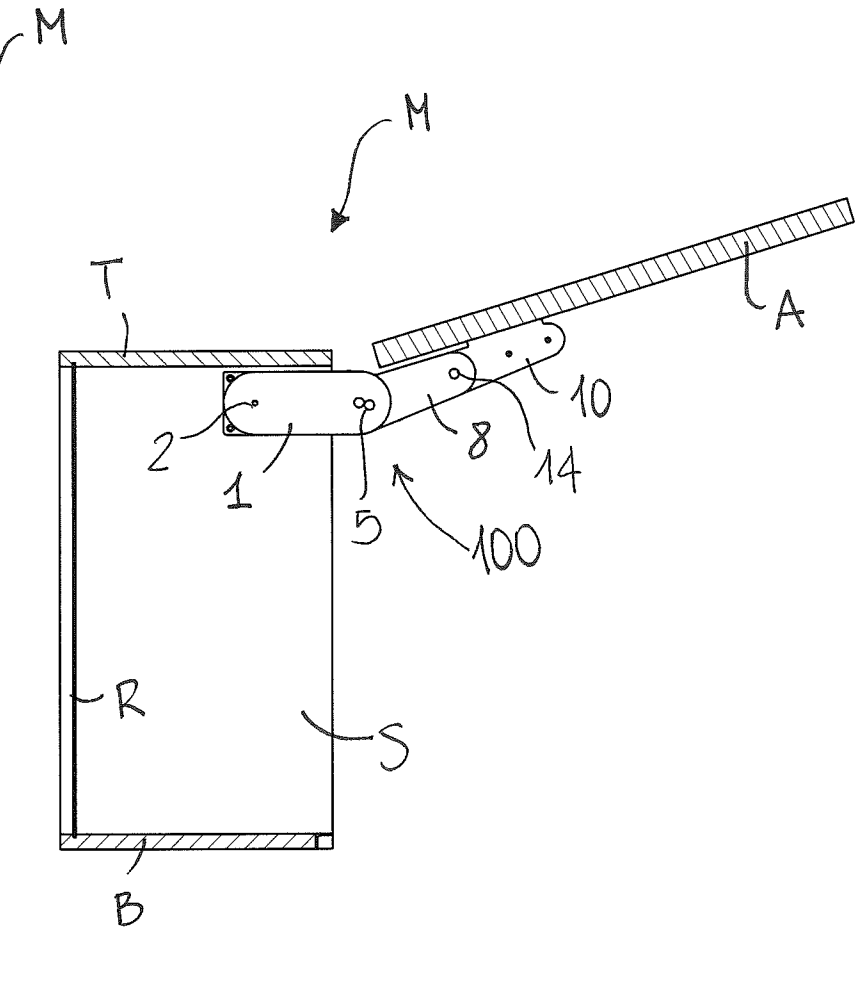
FIG. 2C shows the piece of furniture in the previous figures, sectioned along the C-C plane of FIG. 2B in order to show an assembly of a door according to this invention.
Figure 2B:
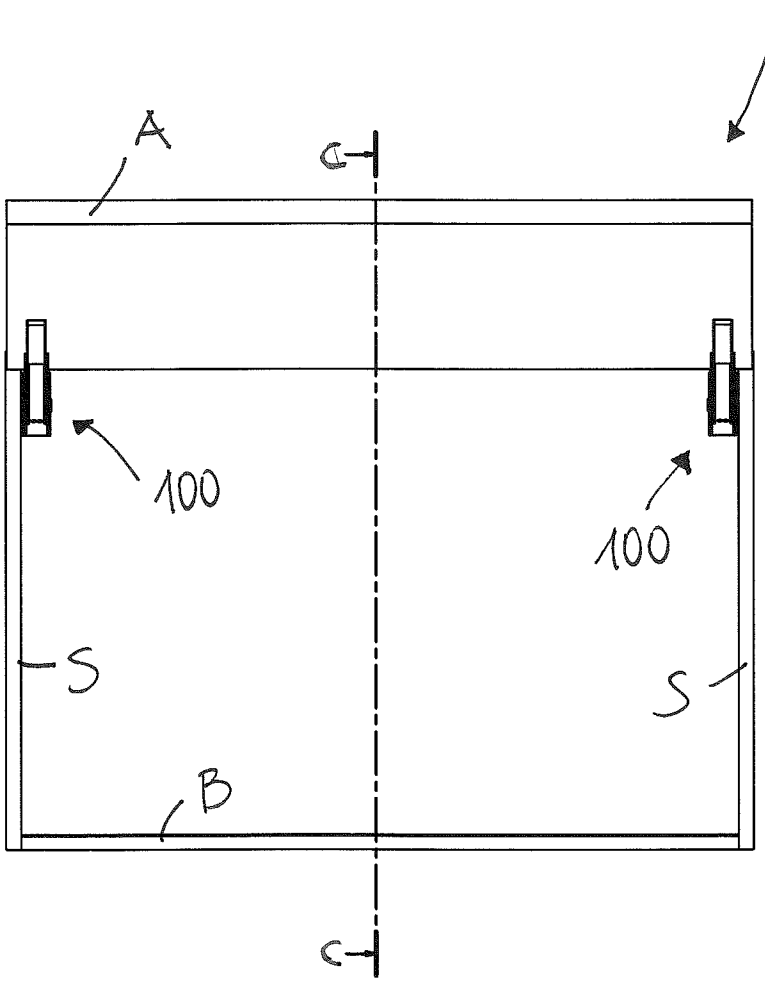
FIG. 2B is a front view of the piece of furniture shown in the previous figure.

Regarding FIGS. 1A-1C and 2A-2C, an assembly 100 for mounting and moving a door A is shown according to this invention suitable to be attached to a piece of furniture M, preferably a cabinet, formed of a parallelepiped body comprising a pair of sides S, made of parallel vertical panels, a cover T, a base B and optionally a rear wall R, defining an inner compartment with a front opening selectively closable with the flat door A.

Said assembly 100 is suitable to be housed in the compartment of the piece of furniture M and associated with the inner surface of said sides S for moving the door A between a closing position, in which it lies on an essentially vertical plane, abutting against the end edges of at least said pair of sides S, substantially closing said front opening, and an opening position, in which said door A is cantilevered regarding the sides S of the piece of furniture M and corresponding with said top T, leaving said front opening at least partially free.

Preferably, for the movement of the door A, a pair of assemblies 100 is used, essentially identical and associated in mirror image to the respective inner surfaces of each of said pair of sides S of the piece of furniture M, so as to improve the weight distribution and therefore the effort and ensure the movement is as smooth as possible.

In the following description, with reference to the attached drawings, the elements and components are described for an assembly 100 fitted on one of the two sides S of the piece of furniture M; of course, the arrangement of elements and components of the assembly 100, which may be attached to the other side S, are symmetrical.

Furthermore, it is pointed out that the directional terms used herein to describe this invention, such as "above, below, vertical, horizontal, upper and lower", as well as any other similar directional term, should be interpreted with reference to an assembly of a door according to this invention when in use.

Due to an advantageous feature of this invention, said assembly 100 comprises a first, second and third arm 1, 8, 10, each formed by a corresponding elongated rigid element, articulated between them in succession to rotatably connect said door A to said side S.

In particular, said first arm 1 is rotatably coupled to the inner surface of an essentially vertical panel forming said side S of the piece of furniture M around a first pin 2 extending substantially orthogonally to said side S, defining an essentially horizontal X-X axis around which said first arm 1 can rotate.

Said second arm 8 is articulated around a second pin 5 at the free end of said first arm 1, and said third arm 10, which can be attached to said door A, is articulated to one end of said second arm 8.

Due to a very advantageous feature of the invention, said first pin 2 essentially forms the only fixed center of rotation of said assembly 100, said second and third pin 5, 14 providing a second axis and a third axis, and in fact a first and a second instant center of rotation, suitable to move together with the corresponding arms 8, 10 on a work surface essentially coinciding, or parallel, with the surface defined by said side S.

Guiding means, such as a pair of tie rods, are also provided as an advantage for guiding the movement of said assembly 100, and therefore of said articulated arms 1, 8, 10, in said work plane in order to provide said door A the desired trajectory, which is roto-translatory, in the changeover between said closing position and said opening position.

Essentially, said assembly 100 can then be moved between a retracted position (FIGS. 1A-1C), wherein said third pin 14, defined as a second instant center of rotation, is positioned at a place between the spaces where said first pin 2 and said second pin 5 are placed, this configuration being taken when said door A is in the closing position, and an extended configuration (FIGS. 2A-2C), wherein said third pin 14 is placed at a place at least equivalent to and preferably higher than the height at which said first pin 2 and said second pin 5 are positioned, this configuration being obtained when said door A is in the opening position.

Furthermore, due to an advantageous feature of this invention, said assembly 100 preferably comprises driving and retaining means 7, placed and configured for driving the opening movement of the door A, then retaining it in the opening position when said assembly 100 is in the extended configuration returning the door A towards the closing position and retaining it in the closing position when said assembly 100 is in the retracted configuration.

Said driving and retaining means 7 are preferably formed with elastic means, such as at least a helical spring, suitably pre-loaded, and preferably coaxially hinged with a first end to said first arm 1 around said first pin 2, and with the opposite end to said second arm 8.

Said first, second and third arms 1, 8, 10 and said guiding rods may possibly be made from rigid essentially flat elements, hence ensuring very small dimensions; however, in this case, an external protection casing should be provided for safety reasons.

Figure 3A:
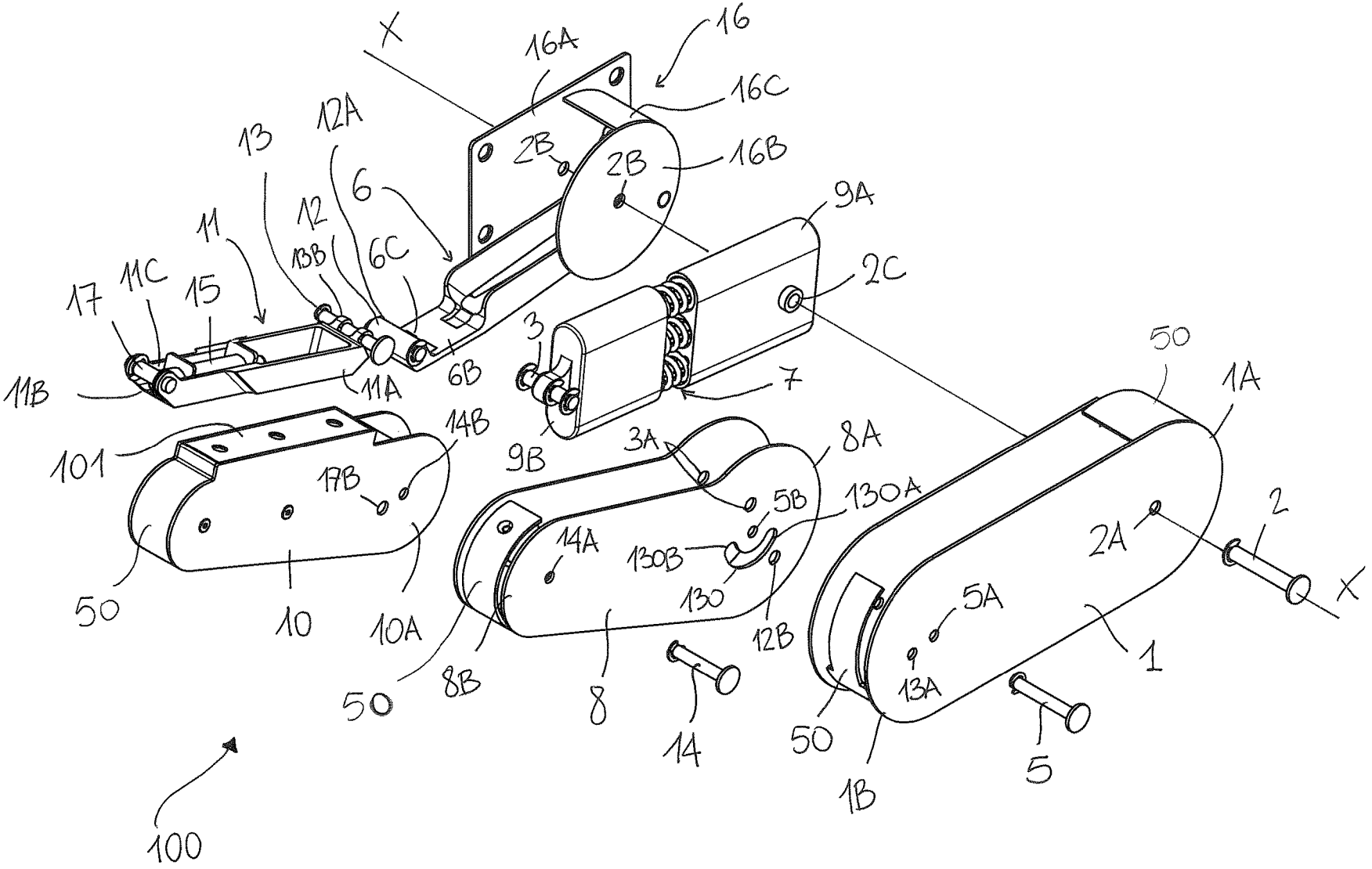
FIGS. 3A and 3B show, in wide views, an assembly of a door for the piece of furniture according to this invention.
Figure 3B:
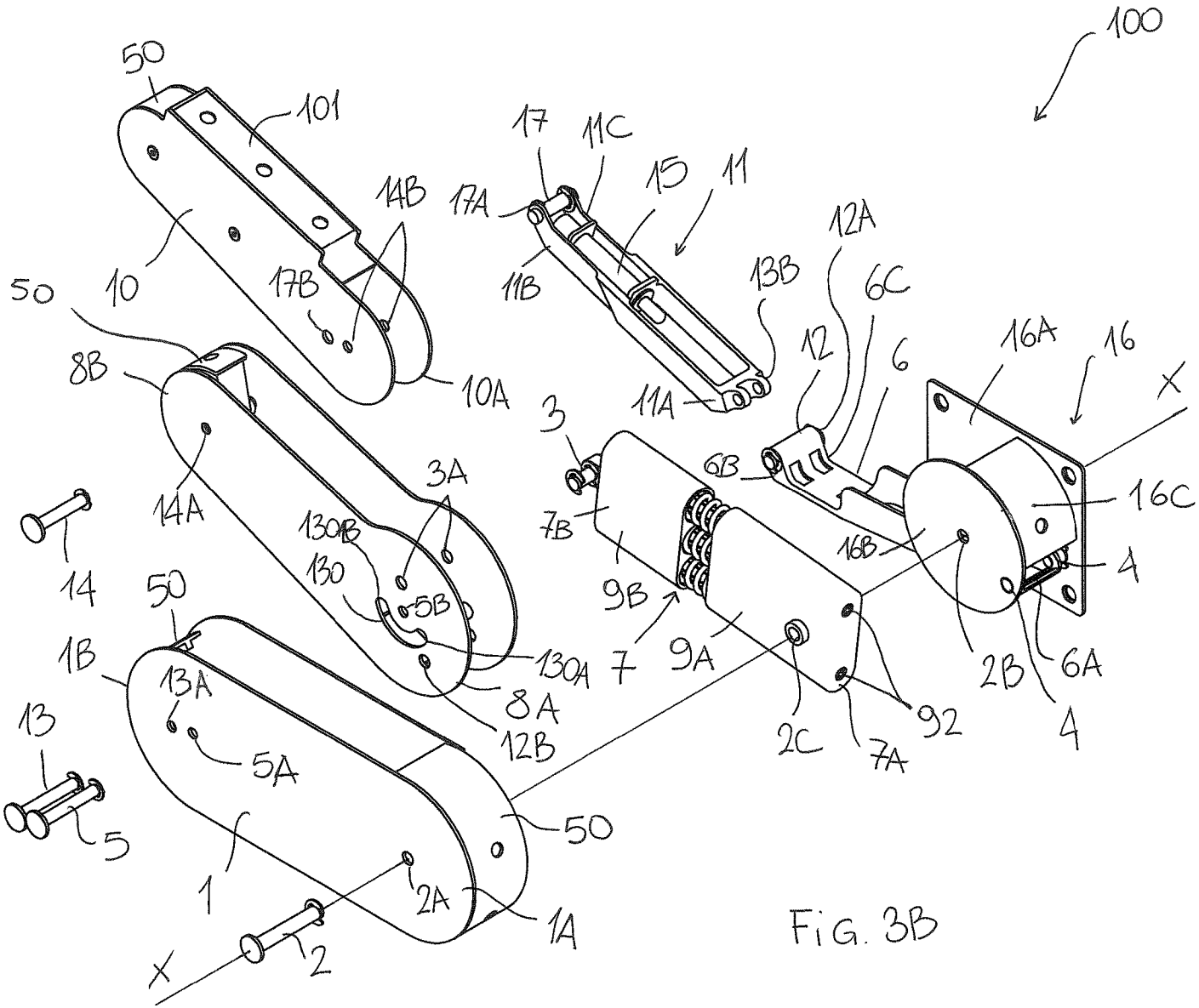

According to a preferred embodiment of this invention, as shown in FIGS. 3A and 3B, said first arm 1, said second arm 8 and said third arm 10 instead are formed by box-shaped rigid hollow bodies, each comprising at least one pair of parallel facing walls, preferably housing the different components and elements internally that provide the movement, such as at least said guiding means 6, 11, which are also preferably formed by bodies with depth, and said driving/retaining means 7; in this way, as an advantage, said assembly 100 does not require the use of any external protection casing.

When appropriate, the protective elements 50 can be provided on said arms 1, 8, 10, preferably in the respective end parts; said protection elements 50 being configured in such a way so that they do not hinder the movement of the assembly 100 during the door A opening and closing operations but they also prevent users from accidently inserting their fingers in the box-shaped bodies comprising said arms 1, 8, 10 when the assembly is in motion.

In particular, said first arm 1 is rotatably coupled with a first end 1A to the inner surface of said side S of the piece of furniture M around said first pin 2, passing through a first pair of coupling holes 2A provided on the respective facing walls of said first arm 1 and extending substantially orthogonally to said side S to define said essentially horizontal X-X axis around which said first arm 1 can rotate.

Preferably, the interface means 16 can be provided for mounting said assembly 100 to the side S of a piece of furniture M; said interface means 16 preferably comprises a first flat part of the interface 16A, adapted to lie on the inner surface of side S of the piece of furniture and firmly attached inside, and a second flat portion 16B of the interface placed facing and parallel to said first flat part 16A and connected to it by means of connecting parts 16C, said first and said second flat part of the interface 16A, 16B being crossed by a second pair of coupling holes 2B, for the passage of said first pin 2.

As explained below in greater detail, said first pin 2 is also adapted to pass through 2C of the third coupling hole, for coaxially connecting said elastic means 7 to said first arm 1 around said fixed X-X axis of rotation.

Said second arm 8 is articulated with a first end 8A to a second end 1B of said first arm 1 around said second pin 5, passing through a corresponding fourth pair of coupling holes 5A placed on the mutually facing walls of said first arm 1 and through a fifth pair of coupling holes 5B provided on the mutually facing walls of said second arm 8.

Lastly, said third arm 10 is articulated to with the first end portion 10A to a second end 8B of said second arm 8, opposite to said first end 8A, around said third pin 14, passing through a sixth and a seventh pair of coupling holes 14A and 14B, respectively provided on the facing walls of said second arm 8 and said third arm 10.

As an advantage, said third arm 10 comprises an interface surface 101 through which said door A can be attached.

As described above, said guiding means preferably comprise a first and a second tie rod guiding means 6, 11, adapted to cooperate with said arms 1, 8, 10 to drive the movement between the retracted position and the extracted position so that said door can perform a roto-translatory motion.

Said first tie rod of the guiding means 6 is preferably articulated with a first end 6A, around a fourth pin 4 attached to side S of the piece of furniture, preferably near said first pin 2, and with opposite end 6B being tied correspondingly to the first end 8A of said second arm 8, around a fifth pin 12.

Preferably, as shown in FIG. 3B, said fourth pin 4 does not pass through but is defined by two coaxial and separate elements, extending from said first and said second flat part of the interface 16A, 16B of said coupling means 16, configured so as not to interfere with the movement of said first pin 2 of said elastic means 7 housed between them and inside the first arm 1.

Said fifth pin 12 can then be inserted through both holes 12A provided on the second end 6B of said first tie rod 6 and is also inserted through a ninth pair of coupling holes 12B made on facing walls of said second arm 8, corresponding to the first end 8A, eccentric with respect to the position of said fifth pair of coupling holes 5B.

Moreover, said first tie rod 6 is formed so that it has, corresponding to the second end 6B, 6C of the housing, a concave base adapted to insert said sixth pin 13 when said assembly 100 is in the extended configuration.

Said second tie rod guiding means 11 is instead articulated with a first end 11A to said first arm 1, at said second end 1B of the latter by means of a sixth pin 13, and with the opposite end 11B being held to said first end 10A of said third arm 10 around a seventh pin 17.

In particular, said sixth pin 13 passes through a tenth pair of coupling holes 13A provided on the mutually facing walls of said first arm 1, eccentric with respect to the position of said fourth pair of coupling holes 5A, and through an eleventh 13B pair of coupling holes obtained on the first end 11A of said second tie rod 11.

Moreover, as an advantage, said sixth pin 13 engages in a sliding manner a pair of guiding slots 130, provided on the facing walls forming said second arm 8, corresponding to the first end 8A of the latter, each extending along a circumference arc with a constant radius in relation to the fifth pair of coupling holes 5B for passing through the second pin 5, and preferably between said holes 5B and the edge of said first end part 8A of said second arm 8.

These guiding slots 130 are configured in such a way that their end edges 130A, 130B are reached by said sixth pin 13 when said assembly 100 takes said retracted configuration and said extended configuration respectively.

Said seventh pin 17 is instead passed through a twelfth pair of coupling holes 17A provided on the second end 11B of said second tie rod 11 and simultaneously corresponding to a thirteenth pair of coupling holes 17B provided on the mutually facing and parallel walls of said third arm 10, eccentric with respect to the positioning of said seventh pair of coupling holes 14B through which said third pin 14 can be inserted.

Moreover, said second tie rod 11 is shaped so that it has, corresponding to the end with which it is attached to said third arm 10, a concave base 11C of the housing and adapted to insert said third pin 14 when said assembly 100 is in the extended configuration.

Dampening means 15, such as a friction piston, can be provided to reduce the movement of the door A when changing from the opening position to the closing position, being preferably housed inside said second tie rod guiding means 11.

Said elastic means 7 preferably comprise a plurality of helical springs extending parallel to each other and inserted with a certain preload inside a containing member 9, or cuff, preferably formed by a pair of containing portions 9A, 9B separated from each other and arranged at respective ends 7A, 7B of said elastic means 7.

As an advantage, said elastic means 7 are coaxially hinged with a first end 7A to said first arm 1 around said first pin 2, and with opposite end 7B to said second arm 8, corresponding to a fourteenth pair of coupling holes 3A provided on the mutually facing walls of its first end 8A, around an eighth pin 3 that is eccentrically positioned with respect to said second pin 5 forming said first instant center of rotation of said assembly 100.

As an advantage, adjusting means 70 of said elastic means 7 may be provided, configured to be able to adapt the assembly 100 for use with doors of various sizes and weights.

Figure 4:
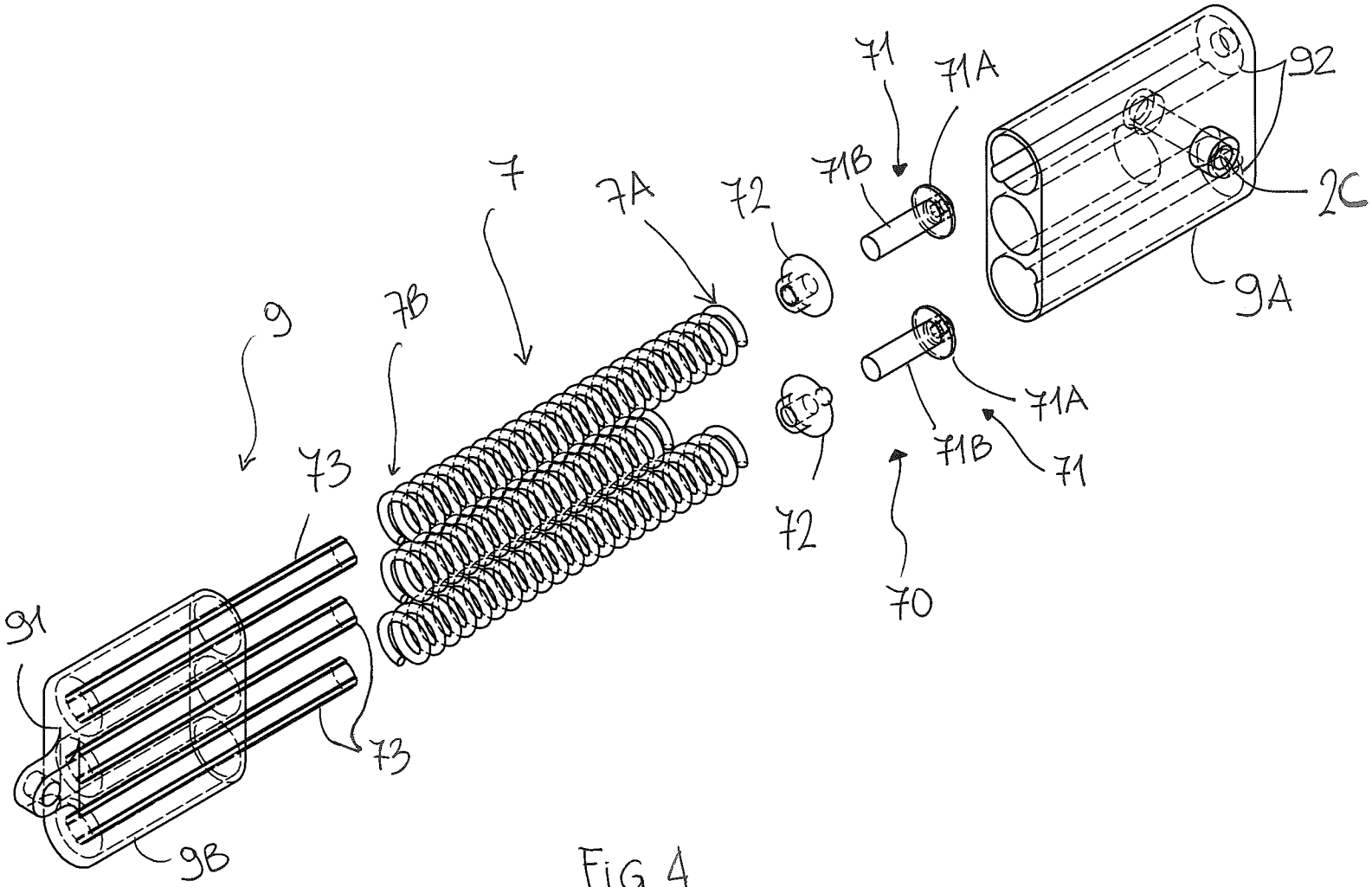
FIG. 4 shows, in a wide view, a component element of an assembly of a door according to this invention.

Regarding FIG. 4, said adjusting means 70 preferably comprise one or more adjusting screws 71, which can be inserted coaxially corresponding to the elastic means 7 by a first end 7A; the said adjusting screw 71 preferably comprises an adjusting head 71A and a threaded rod 71B, on which the first abutment means 72 are provided, such as a washer.

The threaded rod 71B of each of said adjusting screws 71 is suitable to cooperate with the internal thread of the corresponding engaging bodies 73, preferably cylindrical and hollow, coaxially insertable from said second end 7B of said elastic means 7 and integral with second abutment means 91, formed, for example, by a lower support base of said elastic means 7, for example provided on said second containing portions 9B.

To adjust the load placed on said elastic means 7, a suitable tool 71A must be used for the head of said adjusting screw 71, for example by means of placing it through holes 92 provided on the top of said first containing portions 9A; turning in the direction of tightening or in the opposite direction, sliding the thread of the corresponding engaging body 73 along its threads of the rod 71B, compressing or decompressing said elastic means 7 between said first abutment means 72 and said second abutment means 91, imposing the desired preload.

Figure 6:
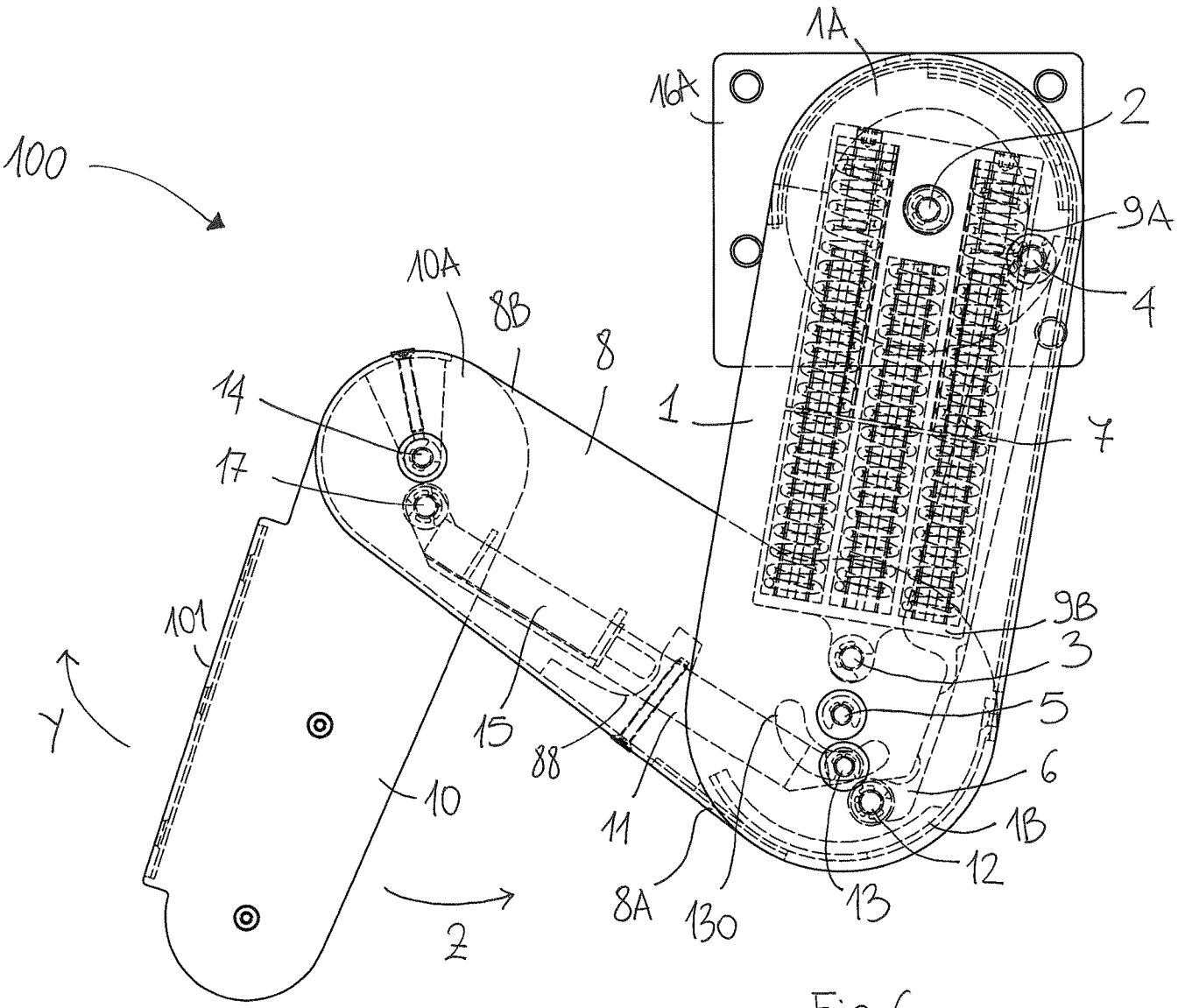
FIG. 6 shows, in a cross-section view, an assembly of a door according to this invention in a particular so-called "deadlock" configuration that occurs in the transition between the retracted configuration and the extended position.

According to a further advantageous feature of the invention, the effect of the lines of force caused by the placement of the various elements in the assembly 100 mentioned above, in the passage between said retracted position and said extracted position, a deadlock can be identified as shown in FIG. 6, essentially aligned with said work plane between said first pin 2, which acts as the fixed center of rotation of said assembly 100 and to which said first end 7A of said elastic means 7 is attached to said second pin 5, forming said first instant center of rotation of said assembly 100, and said eighth pin 3, to which the second end 7B of said elastic means 7 is retained.

Moreover, as an advantage, the deadlock of said assembly 100 is achieved when said elastic means 7 are in a configuration of maximum compression.

In particular, said deadlock is a point in which said assembly 100 is unstably balanced; moreover, a rather limited force, applied for example by the user, leads to the assembly 100 becoming unstable, which is dragged or pushed or drawn back, and the configuration is reached that was initially intended through the action of the elastic means 7.

In other words, when said closing position changes to said opening position, the user opens said door A initially using the grip provided, overcoming the deadlock defined above by continuing with an autonomous movement of the assembly 100, from the retracted position to the extracted position, as indicated by arrow Y in FIG. 6, achieved thanks to the elastic thrust of said elastic means 7, and hence the opening position of the door A is achieved without the user needing to pull it.

Similarly, for the movement in the opposite direction, i.e. from the opening position to the closing position of the door A that the user initially activated, overcoming the deadlock defined above involves continuing the autonomous movement of assembly 100 from the extracted position to the retracted position, as indicated by arrow Z in FIG. 6, achieved thanks to the elastic return of said elastic means 7, and hence the closing position of door A is achieved.

However, the closing movement is further accentuated by the door A's own weight, which acts on said assembly 100. For such purpose, dampening means 15 may be provided in order to slow down the movement of door A so that it reaches the closing position in a controlled manner.

As mentioned above, said dampening means 15 preferably comprise a piston in the clutch housed inside of said second tie rod guiding means 11 and suitable for abutment against a suitable abutment surface 88 provided on said second arm 8 as soon as assembly 100 has overcome the deadlock in direction Z when closing door A.

Figure 5:
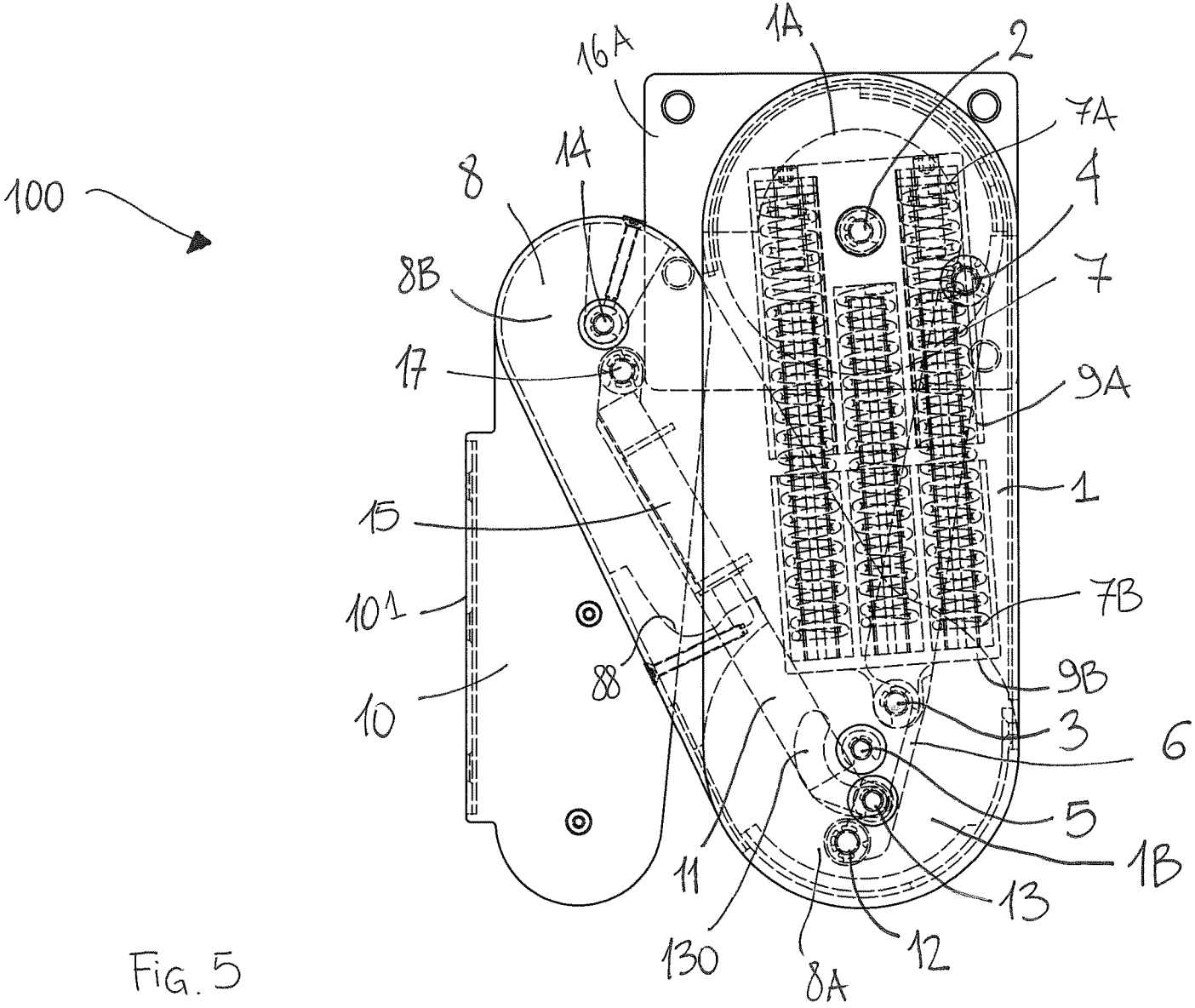
FIG. 5 shows, in a cross-section view, an assembly of a door according to this invention in the retracted configuration.

The operation of an assembly 100 for a door in a piece of furniture M is shown below. Regarding FIG. 5, when the door is in a closing position, i.e. lying on an essentially vertical plane, in abutment against the sides S of the piece of furniture M, said assembly 100 takes on a retracted configuration, in which said first arm 1 and said third arm 10 preferably extend parallel to said door A, while said second arm 8, which is articulated with said second end 1B of said first arm to said first end 10A of said second arm 10, is placed in a slanting position therewith.

Said sixth pin 13, which is articulated by sliding a first end 11A of said second tie rod guiding means 11 to said first position of the end 8A of said second arm 8, is positioned corresponding to said first edge of the ends 130A of said slots 130 and is contextually housed in the base of the housing 6C provided on said first tie rod guiding means 6, corresponding to its second end 6B.

The dampening piston 15 is essentially completely compressed against the respective abutment surface 88 provided on said second arm 8.

In this position, said eighth pin 3, which articulates the second end 7B of said elastic means 7 to said second arm 8, is essentially located outside the axis with respect to the axis that connects said first pin 2 and said second pin 5 along which said first arm 1 extends, and therefore the thrust action of said elastic means 7 is eccentrically released with respect to said second pin 5 in the opposite direction to that of the extraction of the assembly 100, elastically holding the latter in the retracted position.

Regarding FIG. 6, this shows said assembly 100 in a "deadlock" position, i.e. with unstable balance in the changeover between said retracted configuration and said extended configuration.

In this position, as mentioned, said eighth pin 3 is essentially aligned with the axis that connects said first pin 2 and said second pin 5, and said elastic means 7 are thus in the maximum compression position; simultaneously, said sixth pin 13 is released from the housing base 6C provided on said first tie rod guiding means 6, with a translatory motion inside slots 130.

Figure 7:
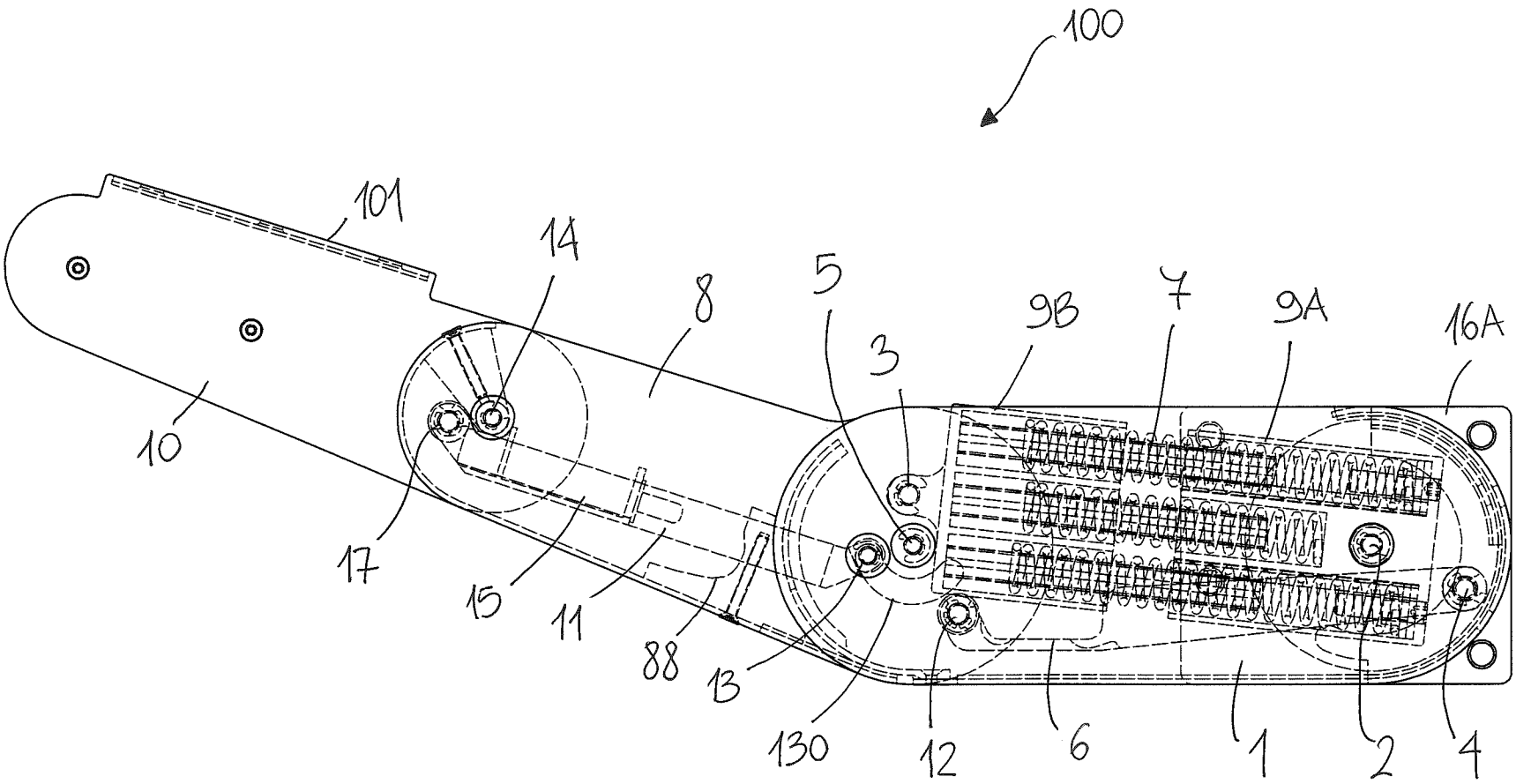
FIG. 7 shows, in a cross-section view, an assembly of a door according to this invention in the extended configuration.
Figure 8A:
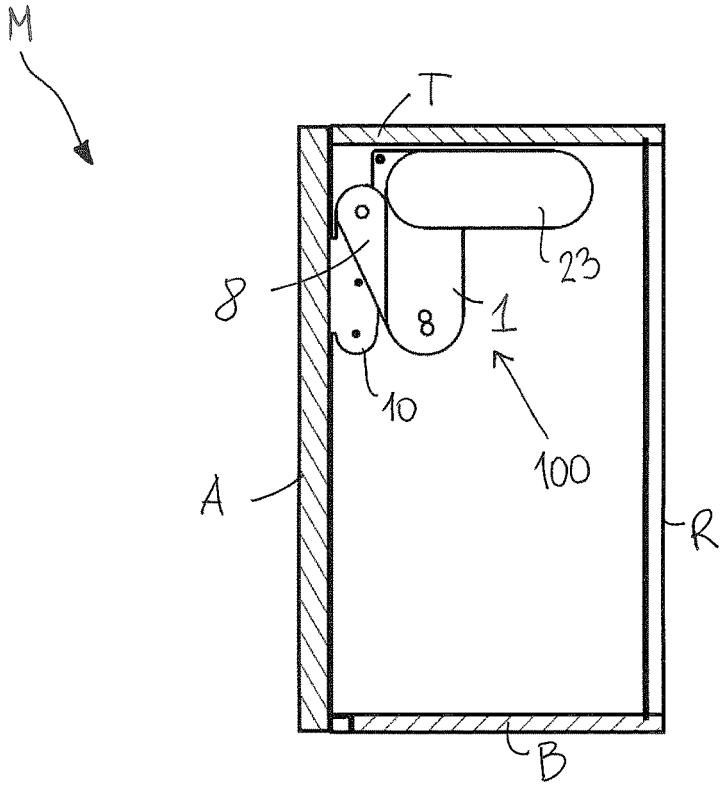
FIGS. 8A and 8B show the second cross-sectional views, a wall-mounted piece of furniture including an assembly of a door according to this invention attached to actuating means, respectively, with the door in closing position, in which the assembly is in the retracted configuration, and in the opening position, in which the assembly is in the extended configuration.
Figure 8B:
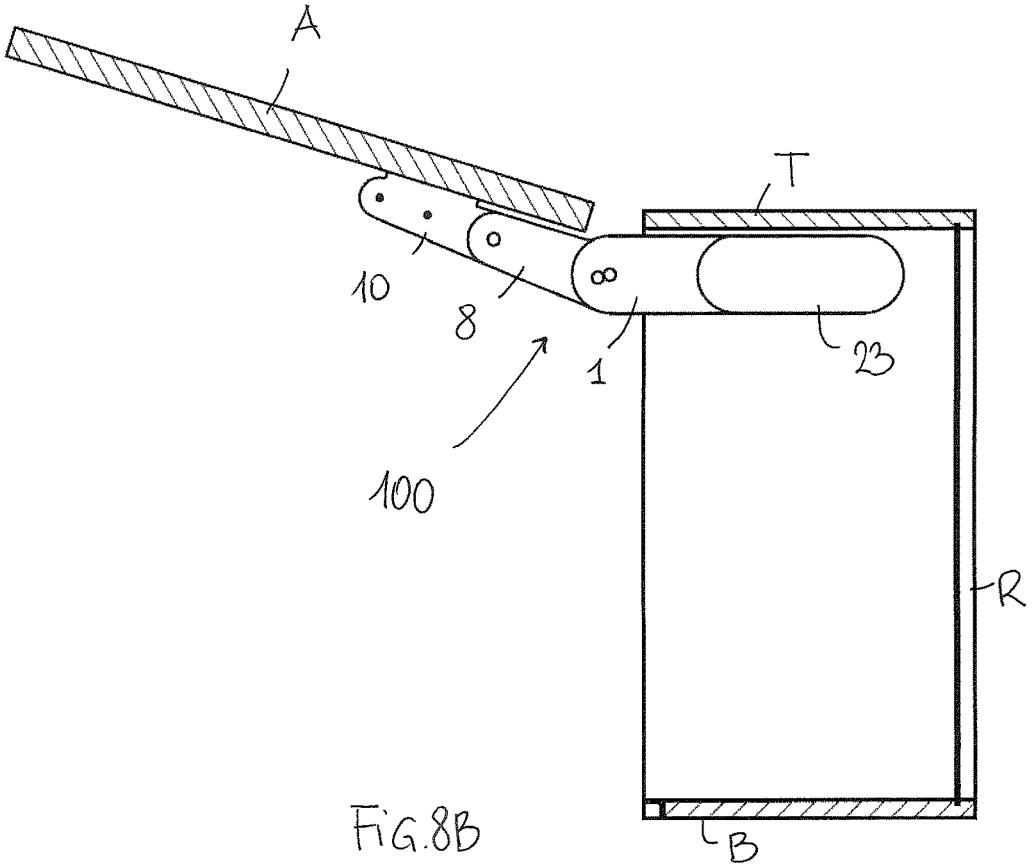
Figure 9A:
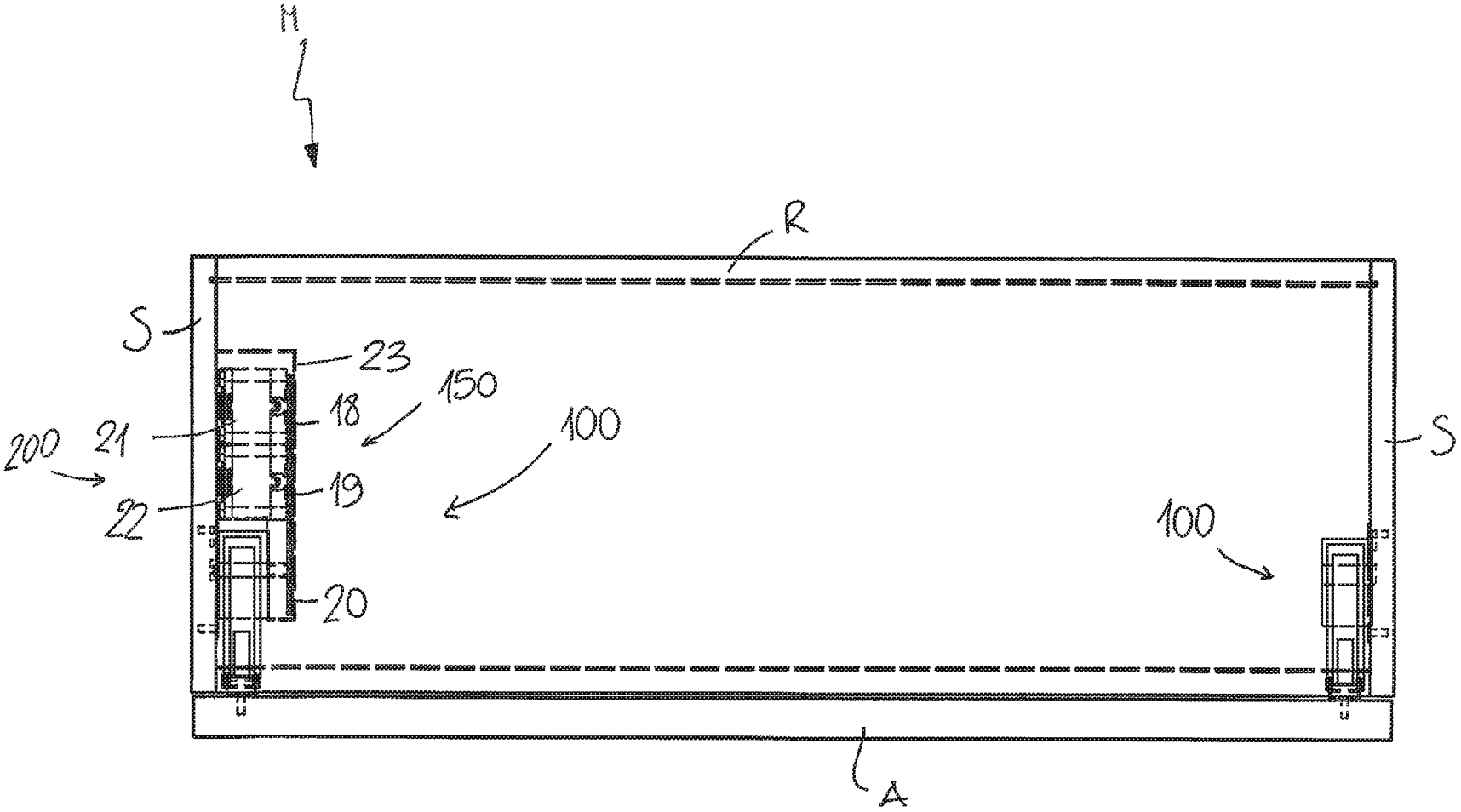
FIG. 9A shows the piece of furniture in a cross-section of FIG. 8A with a horizontal surface corresponding to the cover of the same piece of furniture.
Figure 9B:
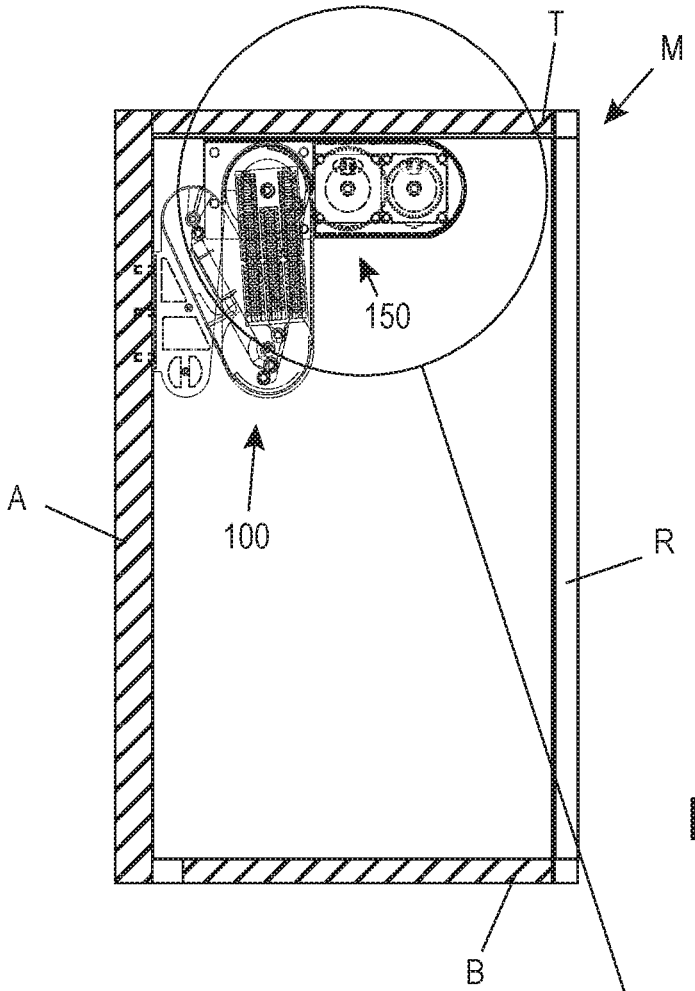
FIG. 9B shows the piece of furniture in a cross-section of FIG. 8A, with the assembly of the door according to this invention, attached to actuating means, which in turn are also shown in cross-section.
Figure 9C:
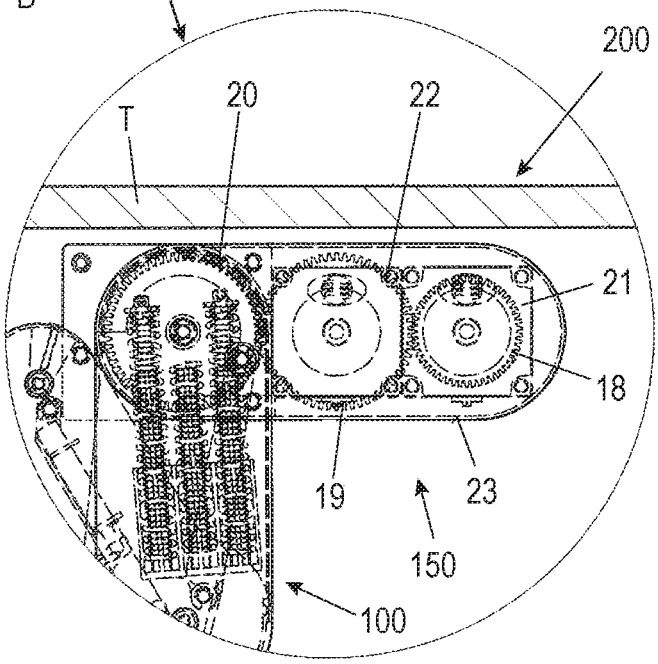
FIG. 9C shows the suitably enlarged circled detail of 9B.

Finally, regarding FIG. 7, it shows assembly 100 in the extended configuration. this position said assembly 100 has made a rotation around said X-X axis with respect to the retracted configuration, while said door A has performed a roto-translatory motion until it reaches the opening position.

The limit switch of this movement can be determined for example by the contact of the second containing portions 9B of said elastic means 7 with said second pin 5, or by the contact between said third pin 14 and the dampening piston 15, if included.

Said sixth pin 13 is now positioned corresponding to said second edge of the ends 130B of said slot 130, while said third pin 14 is essentially housed in the corresponding housing base 11C provided on said second tie rod guiding means 11 corresponding to its second end 11B.

In this position, said eighth pin 3, which connects the second end 7B of said elastic means 7 to said second arm 8, is essentially located outside the axis that connects said first pin 2 and said second pin 5 along which said first arm 1 extends, now essentially horizontal, and then the pushing action of said elastic means 7 is released eccentrically with respect to said second pin 5, in the extraction direction of assembly 100, elastically holding the latter in the extended position.

In order to close door A, the aforementioned actions are carried out in reverse. The limit of the closing movement of door A can be determined by stopping the door A against sides S of a piece of furniture M, or from reaching the limit of the dampening piston 15, if included.

As a particular advantage of an embodiment of this invention, shown in FIGS. 8A, 8B, 9A-9C, actuating means 200, such as an electric motor, can be connected to said assembly 100 through transmission means 150 in order to assist in the operations to open and/or close door A of the piece of furniture M.

In particular, said actuating means 200 may for example comprise at least one electric motor and preferably a pair of electric motors 21, 22 are also connected to side S of the piece of furniture M, said transmission means 150 as an advantage comprising one or more toothed wheels 18, 19 adapted to rotatably transmit the movement to a corresponding toothed wheel 20 mounted coaxially to said first pin 2 and integral with said first arm 1.

If necessary, a protective casing 23 is provided to cover said actuating means 200 and said transmission means 150.

Finally, a lighting device, for example a LED spotlight (not shown), is preferably housed in the box-shaped body of said third arm 10. Said lighting device can be operated by a suitable electrical switch in order to turn it on and off; as an alternative, as an advantage, said lighting device can be activated automatically by systems known by those skilled in the art, in accordance with the movement of door A.

In conclusion, from the foregoing it is obvious how the movement assembly of a door A of a piece of furniture M according to this invention is required to achieve the purposes and advantages originally expected.

As can be seen from the description and from the drawings, the assembly 100 is very compact due to providing a single fixed center of rotation for the movement of the articulated arms.

As an advantage, an assembly 100 according to this invention is also safe, thanks to the fact that the different means and devices that allow its movement, such as said guiding means rods 6,11 and said activation and retaining means 7, can be housed inside the box-shaped body of said articulated arms; therefore, in fact, there are no openings to the inside of the assembly that would allow the users to place their fingers, furthermore additional cover casing does not need to be used.

In addition, an assembly 100 according to this invention requires a minimum number of fixed points with respect to the side of the piece of furniture, in particular essentially two, i.e. said first pin 2 and said fourth pin 4, adapted for being placed near said first pin 2 in order to be covered by said first arm 1, thereby helping to preserve the aesthetic appearance of the piece of furniture and also being aesthetically pleasing.

Finally, an assembly of doors according to this invention is absolutely practical and ensures smooth movement of door A of any size and weight.

Obviously, this invention can have numerous applications, modifications or variants without reducing the scope of protection, as defined by the attached claims. Moreover there could be more suitable materials and equipment used for the embodiment of this invention, as well as the shapes and sizes of the individual components depending on the specific requirements.

What is claimed is:

1. An assembly (100) for moving a door (A) of a piece of furniture (M) comprising at least one side (S), said assembly (100) being adapted to move between a retracted configuration and an extended configuration via a driving and retaining means so as to drive said door (A) respectively between a closing position, wherein said door (A) lies essentially on a vertical plane, and an opening position, wherein said door (A) is cantilevered with respect to said side (S), according to a roto-translatory motion, wherein the assembly further comprises a first arm (1) adapted to be rotatably coupled with a first end (1A) to said side (S) around a first rotational axis, a second arm (8) articulated with a first end (8A) to a second end (1B) of said first arm (1) around a second rotational axis, a third arm (10) articulated to a second end (8B) of said second arm (8) around a third rotational axis, said third arm (10) being configured to be connected with said door (A), guiding means (6, 11) being provided for guiding said roto-translatory motion of said door (A) between said closing position and said opening position, wherein the driving and retaining means (7) is arranged and configured for driving the opening movement of said door (A) and retaining said door (A) in the opening position when said assembly (100) is in the extended configuration, and returning said door (A) towards the closing position and retaining said door (A) in the closing position when said assembly (100) is in the retracted configuration, wherein the driving and retaining means (7) comprise preloaded elastic means hinged with a first end (7A) coaxially to said first arm (1) around said first rotational axis, and with an opposite end (7B) to said second arm (8), and wherein in a passage between said retracted configuration and said extended configuration, said assembly (100) rotates around said first rotational axis, forming a fixed center of rotation, said second and third rotational axes forming instant centers of rotation, movable together with a respective one of the arms (1, 8, 10).

2. The assembly (100) according to claim 1, wherein at least one of the first rotational axis, the second rotational axis or the third rotational axis is provided by a pin.

3. The assembly (100) according to claim 1, wherein said elastic means comprise a plurality of helical springs, housed inside a containing member (9) formed by a first and a second containing portions (9A, 9B), separated from each other and arranged at respective ends (7A, 7B) of said plurality of helical springs.

4. The assembly (100) according to claim 1, further comprising adjusting means (70) for adjusting the preload of said elastic means, comprising at least one adjusting screw (71) integral with first abutment means (72) and coaxially insertable from a first end (7A) of said elastic means (7), said adjusting screw (71) being adapted to cooperate with a corresponding engaging body (73) coaxially insertable from said second end (7B) of said elastic means (7) and integral with second abutment means (91) to compress or decompress said elastic means (7) between said first and said second abutment means (72, 91).

5. The assembly (100) according to claim 1, wherein said guiding means (6, 11) comprise a first tie rod (6) articulated with a first end (6A) about a fourth rotational axis associable with said side (S) and with the opposite end (6B) being connectable to said second arm (8) around a fifth rotational axis, and a second tie rod (11) articulated with a first end (11A) to the second end (1B) of said first arm (1) about a sixth rotational axis, and with the opposite end (11B) being connected to said first end (10A) of said third arm (10) about a seventh rotational axis.

6. The assembly (100) according to claim 5, wherein at least one of the fourth rotational axis, the fifth rotational axis or the sixth rotational axis is provided by a pin.

7. The assembly (100) according to claim 1, wherein said first arm (1), said second arm (8) and said third arm (10) are formed by box-shaped rigid hollow bodies, housing at least said guiding means (6,11) and said driving and retaining means (7).

8. The assembly (100) according to claim 1, comprising dampening means (15) for dampening and controlling movement of said door (A) in the passage from said opening position to the closing position.

9. The assembly (100) according to claim 1, wherein actuating means (200) are associated with said assembly (100) through transmission means (150) to facilitate movement of said door (A), said actuating means (200) comprising at least one electric motor (21, 22) associated with said side (S), said transmission means (150) comprising at least one toothed wheel (18, 19) adapted to rotatably transmit motion imparted by said at least one electric motor (21, 22) to a corresponding toothed wheel (20) mounted coaxially to said first rotational axis and integral with said first arm (1).

10. An arrangement comprising the assembly according to claim 1, and further comprising the piece of furniture (M) provided with the at least a side (S) and the door (A).

* * * * *